US008887960B2

(12) United States Patent
Hardman

(10) Patent No.: US 8,887,960 B2
(45) Date of Patent: Nov. 18, 2014

(54) DISPENSING STATION

(76) Inventor: Eric Hardman, LaGrange, IL (US)

( * ) Notice: Subject to any disclaimer, the term of this patent is extended or adjusted under 35 U.S.C. 154(b) by 635 days.

(21) Appl. No.: 12/927,178

(22) Filed: Nov. 9, 2010

(65) Prior Publication Data

US 2011/0121031 A1 May 26, 2011

(51) Int. Cl.

| | |
|---|---|
| ***B67D 7/70*** | (2010.01) |
| ***B67D 7/56*** | (2010.01) |
| ***B67D 7/84*** | (2010.01) |
| ***B67D 7/06*** | (2010.01) |
| ***A47F 1/03*** | (2006.01) |
| ***B67D 7/02*** | (2010.01) |

(52) U.S. Cl.

CPC .... *A47F 1/03* (2013.01); *B67D 7/02* (2013.01)
USPC ..... 222/132; 222/183; 222/165; 222/156; 222/135

(58) Field of Classification Search

USPC ..... 222/129, 132, 135, 180, 181.3, 185.1, 222/160, 164, 165, 167, 154, 156, 183, 222/181.2; 312/35, 245, 242

See application file for complete search history.

(56) References Cited

U.S. PATENT DOCUMENTS

| | | | | | |
|---|---|---|---|---|---|
| 486,919 | A * | 11/1892 | Winget | 220/543 |
| 508,326 | A * | 11/1893 | Lippincott | 222/130 |
| 582,697 | A * | 5/1897 | Schneider | 312/210.5 |
| 626,085 | A * | 5/1899 | Ormerod | 222/165 |
| 1,441,410 | A * | 1/1923 | Eustis | 312/242 |
| 1,840,595 | A * | 1/1932 | Moore | 222/132 |
| 2,774,393 | A * | 12/1956 | Swan | 141/18 |
| 3,130,873 | A * | 4/1964 | Klutz, Jr. | 222/131 |
| 3,187,954 | A * | 6/1965 | Hammer et al. | 222/153.03 |
| 3,349,967 | A * | 10/1967 | Schneller | 222/130 |
| 5,143,262 | A * | 9/1992 | Edlund | 222/129 |
| 5,183,182 | A * | 2/1993 | Comstock et al. | 222/129 |
| 5,413,251 | A * | 5/1995 | Adamson | 222/129 |
| 5,452,825 | A * | 9/1995 | Comstock et al. | 222/135 |
| 6,761,285 | B2 * | 7/2004 | Bertone | 222/94 |
| 6,938,801 | B1 * | 9/2005 | Reddy et al. | 222/214 |
| 2002/0070235 | A1 * | 6/2002 | Childers | 222/132 |

* cited by examiner

*Primary Examiner* — Kevin P Shaver
*Assistant Examiner* — Stephanie E Williams
(74) *Attorney, Agent, or Firm* — Olson & Cepuritis, Ltd.

(57) ABSTRACT

A dispensing cabinet for dispensing bulk materials such as laundry detergent, fabric softener and bleach is disclosed. The cabinet has an upstanding housing having a base and defining an enclosure for receiving a plurality of liquid containers. The cabinet also includes a face panel pivotably mounted to the housing adjacent the base and including a shelf extending into the hollow enclosure. The face panel defines apertures through which lateral dispensing nozzles unitary with each container, are inserted. The containers are mounted for pivotal movement together with the face panel for ready servicing.

13 Claims, 4 Drawing Sheets

DISPENSING STATION

CROSS-REFERENCE TO RELATED APPLICATION

This application claims priority to patent application Ser. No. 61/280,802, filed Nov. 9, 2009, which is incorporated herein by reference.

TECHNICAL FIELD OF THE INVENTION

The invention relates to devices for dispensing bulk materials, especially pourable materials such as liquids, powders, granules and beads. In particular, the invention relates to an arrangement for holding a plurality of containers, each having their own dispensing nozzle, each of which can be independently replaced as needed, or refilled.

BACKGROUND OF THE INVENTION

In many applications it is desirable to provide dispensing or packaging of small quantities of materials taken from a bulk container, on a demand basis, in a home laundry room as well as in laundromats or the like laundry facilities, such as those located in the communal area of an apartment building are reserved for patronage by a number of individuals who bring their articles to the facility site. While a user may provide their own laundry materials such as bleach, fabric softener and detergent, it may be cumbersome to carry or handle bulk containers of these materials. Accordingly, it has been found convenient in many facilities of this type, to provide a dispensing station at which appropriate quantities of laundry-related materials can be obtained, on demand, by users of the laundry equipment.

With the advent of new technology, modern laundry equipment may also require types of materials such as special detergents, not commonly in use or readily available to the average consumer. It is in the interest of the facility provider that appropriate detergent materials be made readily available, that match the particular type of equipment employed. For reasons of appropriate material selection as well as convenience, as pointed out herein, dispensing stations are undergoing a renewed popularity.

One problem that has arisen for those responsible for maintaining the dispensing stations, is the efficiency with which bulk containers may be refilled, replaced or otherwise renewed or recharged on a repeated and often times periodic basis. It is important that the dispensing station employ containers which are readily accessible to service personnel while discharging their responsibilities. Further refinement in dispensing stations to accomplish these and other goals are still being sought.

SUMMARY OF THE INVENTION

In one aspect, the present invention provides novel and improved apparatus and methods for dispensing liquids and other materials from bulk containers. The present invention minimizes the disadvantages associated with the prior art and provides advantages in construction, mode of operation and use. In one example of the apparatus, a dispensing cabinet for dispensing a free flowing material, such as liquids, powders, granules or beads is provided which comprises an upstanding housing having a base and defining an enclosure for receiving a plurality of containers for the materials to be dispensed. A face panel is pivotably mounted to the housing adjacent to the housing base. A shelf on the face panel extends inwardly into the enclosure and is sized to support the containers that are each provided with a lateral dispensing nozzle unitary therewith. The face panel defines a number of apertures equal to the number of dispensing containers and is sized to receive therethrough the lateral dispensing nozzles. In one example, the face panel also includes a plurality of viewing windows through which the container contents are observable, so as to monitor the amounts of material contained in each container. In another example, the housing further defines a storage cavity disposed adjacent the face panel for storing measuring cups and the like. In a further example, the storage cavity is provided with a pull-out drawer located beneath the face panel.

In yet another example of the apparatus, a liquid dispensing station includes a plurality of liquid containers, each provided with a lateral dispensing nozzle unitary therewith. A cabinet includes an upstanding housing defining an opening communicating with the hollow interior, a base and a face panel that is selectably pivotable to close the opening. The cabinet defines an aperture that is dimensioned for receiving the plurality of liquid containers. The face panel is pivotably mounted to the housing adjacent to the base for movement between a closed position closing the opening and an open position providing access to the hollow interior. A shelf on the face panel extends inwardly into the enclosure and is sized to support the liquid containers. The face panel defines a number of apertures equal to the number of the liquid dispensing containers, with the apertures receiving the lateral dispensing nozzles therethrough. A releasable latch carried on the face panel engages the housing so as to hold the face panel in a predetermined closed position with respect to the housing. A flexible tether extending between the face panel and the housing limits the pivotal movement of the face panel when extended to an open position, to allow for convenient servicing, e.g., refilling or replacing of the liquid containers carried on the face panel.

In one example of the method aspect of this invention, steps for dispensing liquid include providing a plurality of liquid containers having a lateral dispensing nozzle unitary therewith. Also provided is a cabinet including an upstanding housing having a base and defining an opening communicating with a hollow interior and a face panel movable to close the opening. The method further includes pivotally mounting the face panel to a portion of the housing adjacent to the housing base, for movement between an open, service position away from the housing that provides access to the hollow interior and a closed, use position closing the opening so as to define a common enclosure for receiving the plurality of liquid containers. A shelf is provided for the face panel and is sized to support the liquid containers. The shelf is mounted on the face panel so as to extend into the hollow interior and a number of apertures are defined in the face panel, equal in number to the number of dispensing containers. The method also includes supporting the liquid containers with the shelf to align the liquid containers with respect to the face panel, while aligning the lateral dispensing nozzles with the apertures. The method further includes extending the lateral dispensing nozzles through the apertures to hold the lateral dispensing nozzles in a service position and the method concludes with opening the lateral dispensing nozzles, with the face panel in the closed position, to dispense the contents of the liquid containers.

DETAILED DESCRIPTION OF THE PREFERRED EMBODIMENT OF THE INVENTION

Figure 1:
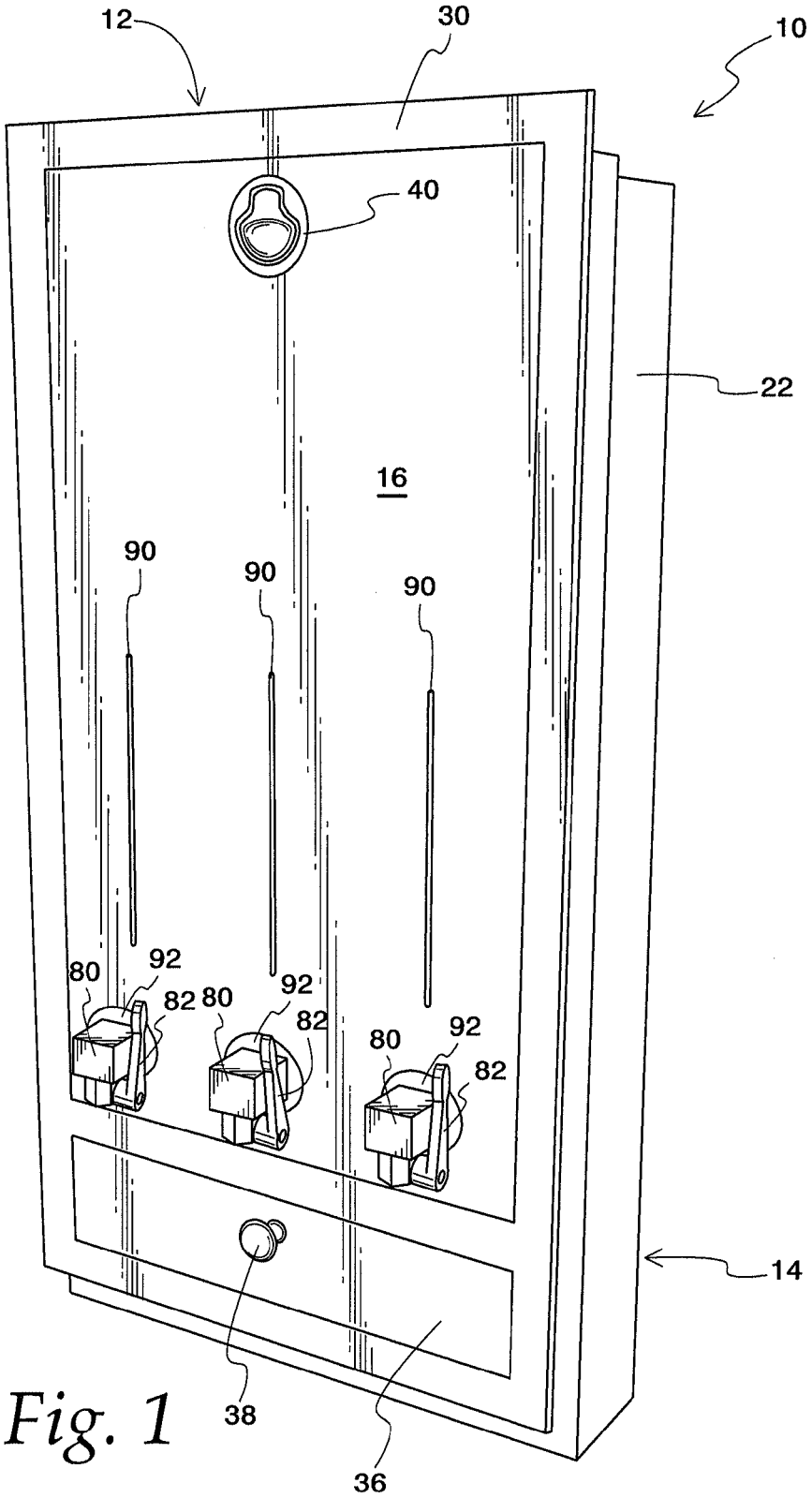
FIG. 1 is a perspective view of a preferred embodiment of a dispensing cabinet suitable for mounting at a station.

The invention disclosed herein is, of course, susceptible of being embodied in many different devices. Shown in the drawings and described herein below in detail are preferred embodiments of the invention. It is to be understood, however, that the present disclosure is an exemplification of the principles of the invention and does not limit the invention to the illustrated embodiments.

Figure 2:
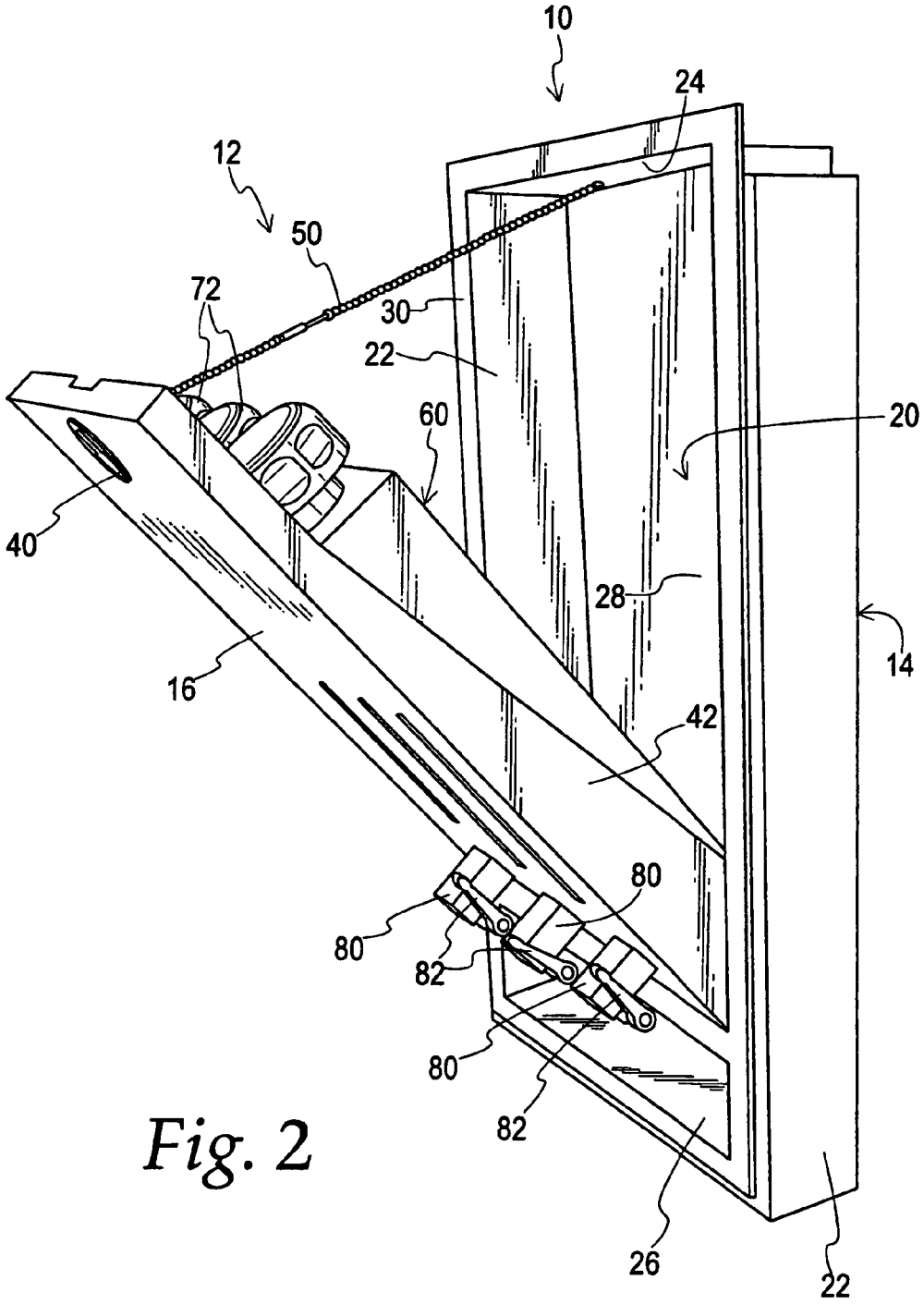
FIG. 2 is a perspective view thereof with the cabinet being opened in preparation for service.

A preferred embodiment of the dispensing station 10 is shown in FIG. 1. Included is a dispensing cabinet, generally indicated at 12, having a hollow housing 14 and a face panel 16. With reference to FIGS. 1 and 2, housing 14 defines a hollow interior 20 (FIG. 2) defined by sidewalls 22, top wall 24, bottom wall 26 and a rear wall 28. In the illustrated embodiment, housing 14 is adapted for recessed mounting within a structural wall or the like. An outer border or frame 30 surrounds the opening defined by housing 14 and provides convenient mounting to wall studs or other components of the wall within which the housing is mounted. If desired, the housing may be mounted, without modification, to the surface of a wall using conventional fasteners, for example, by securing back wall 28 directly to the wall surface.

In the preferred embodiment, housing 14 and face panel 16 are preferably formed of sheet metal material using conventional metal forming and joining techniques. If desired, however, the housing and face panel components of cabinet 12 can be made from other materials such as plastic or wood, as well as composite structures such as fiberglass having internal support members. Further, the face panel and housing may be made of different materials, if desired. In the preferred embodiment, face panel 16 is formed as a single integral component, as is housing 14.

As shown in FIG. 1, cabinet 12 of the illustrated embodiment includes an optional access door 36 or panel having a knob 38 to gain access to a storage cavity in the lower portion of housing 14, for storing measuring cups or other implements. The storage cavity 33 is visible in FIG. 2, where optional door 36 has been omitted. Door 36 preferably forms part of a pull out drawer assembly for containing the implements, but could also comprise a hinged door to provide access to the storage cavity. Preferably, the storage cavity 33 behind door 36 is separated by a horizontal divider partition or wall (not shown) from the larger, upper portion of the housing interior enclosed by face panel 16. The optional divider wall may be omitted, if desired.

As indicated in FIG. 2, face panel 16 is hingedly or pivotably connected at its bottom portion to a lower portion of housing 14, such as portions of sidewalls 22, spaced above bottom wall 26 and above the optional storage cavity 33 as well. As can be seen in FIG. 2, face panel 16 includes tapered side walls 42 and a top wall that extend in the direction toward the interior of housing 14, enclosing the interior surface of face panel 16.

Figure 5:
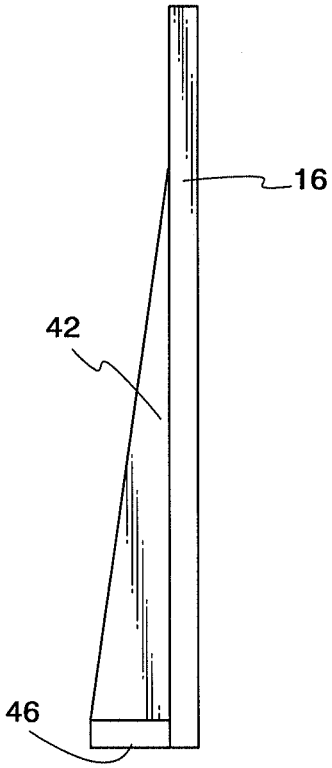
FIG. 5 is a side elevational view thereof.
Figure 4:
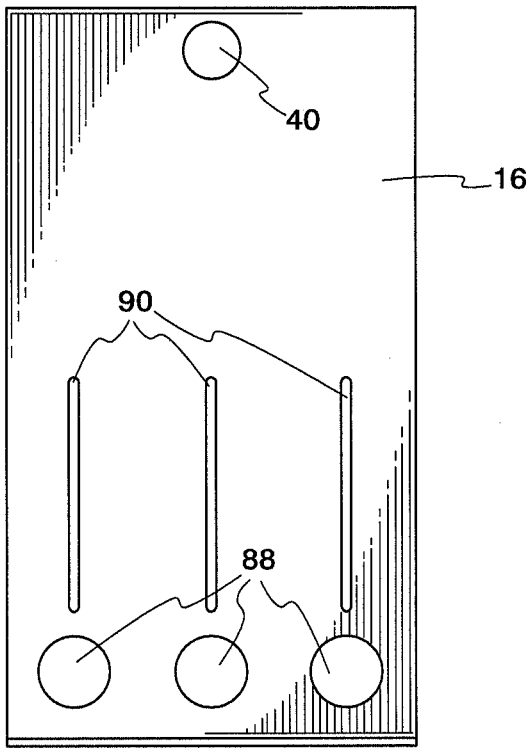
FIG. 4 is a front elevational view of the face panel.

Face panel 16 is also shown in FIGS. 4 and 5. Face panel 16 includes a horizontal shelf 46 (FIG. 5) at its bottom end, adjacent the preferred point of pivotal connection of the face panel 16 to housing 14. The preferred pivotal connection, as will be seen herein, provides convenient and efficient servicing of the containers 60 within the interior of housing 14.

Referring to FIG. 4, face panel 16 includes apertures 88 through which the dispensing nozzles 80 extend, in the manner indicated for example in FIGS. 1 and 2. The dispensing nozzles 80 may include optional enlarged valve body portions 92 that engage apertures 88 (see FIG. 1) with a close tolerance fit to hold the container 60 in position with respect to face panel 16. In the preferred embodiment, it has not been found necessary to secure the upper ends of container 60 to face panel 16, although additional securement can be provided in a conventional manner, if desired. For example, face panel 16 can be provided with flexible locking fingers extending toward the interior of housing 14, so as to engage the upper surfaces of container 60, locking the upper ends of container 60 in place. If desired, internal divider members can extend inwardly from face plate 16 toward the housing interior so as to partly or fully separate one container 60 from the other, although such has not been found to be necessary. Face panel 16 also includes a plurality of elongated viewing windows or slots 90 which extend along the vertical height of the respective containers 60 so that the amount of material present in each container may be directly viewed. The front walls 66 of container 60 may be made completely or partly of transparent or translucent material, so that the level of the container content may be readily viewable through the windows or slots 90.

As indicated in FIG. 2, a flexible tether 50 provides a convenient limit to the outward pivoting of face panel 16. In this manner, the weight of face panel 16 and components carried thereon is supported by the flexible tether, allowing an operator use of both hands to service the dispensing station as required. If desired, flexible tether 50 may be omitted. In the preferred embodiment, a latch member 40 releasably secures the upper end of face panel 16 to housing 14.

If desired, face panel 16 may be removably attached to housing 14 in any of a variety of conventional ways, such as threaded fasteners securing the face panel to the housing. Further, the bottom pivotal connection of face panel 16 may be slotted in a downwardly opening direction such that the face panel 16 can be outwardly translated after pivoting, so as to remove the face panel from the remainder of cabinet 12.

Figure 3:
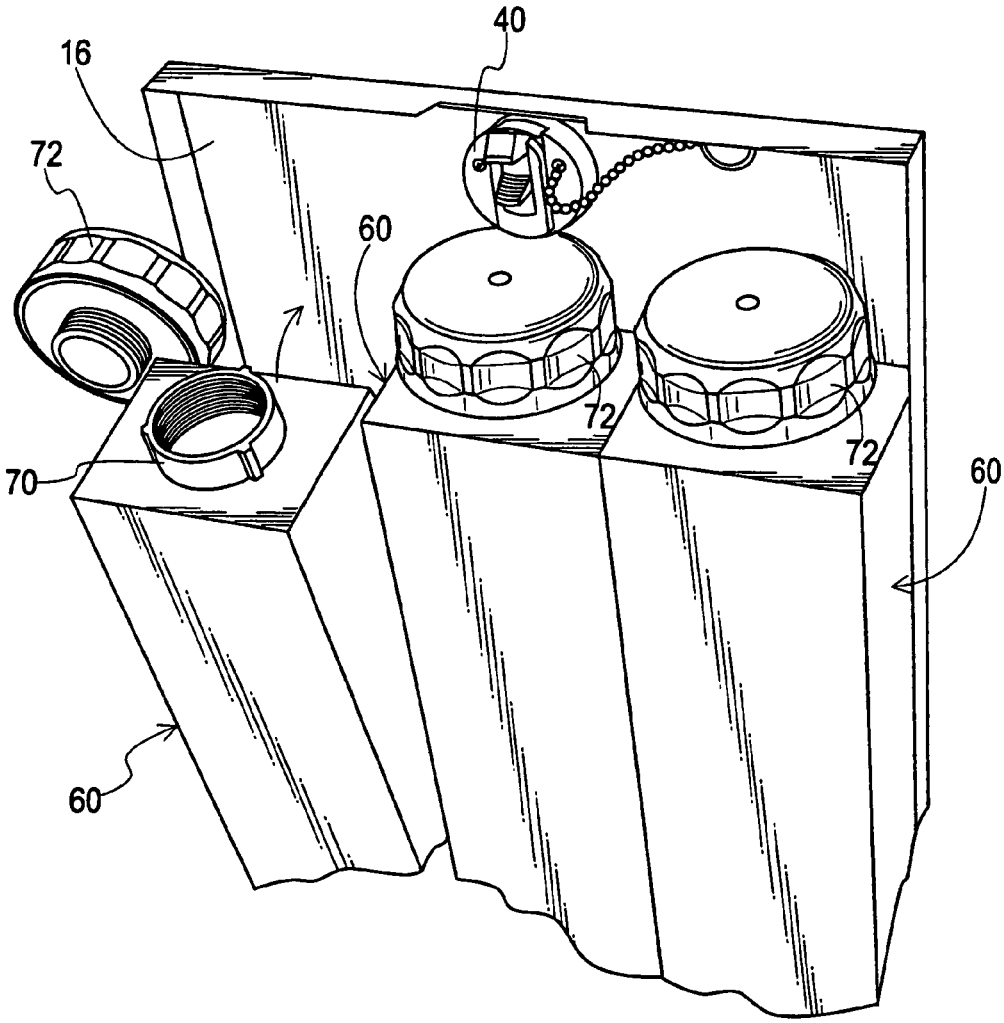
FIG. 3 is a fragmentary perspective view of an interior portion thereof showing upper portions of the containers carried on a face panel of the dispensing station.
Figure 7:
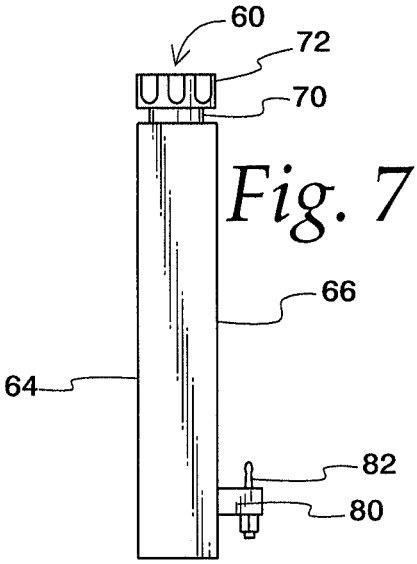
FIG. 7 is a side elevational view thereof.
Figure 6:
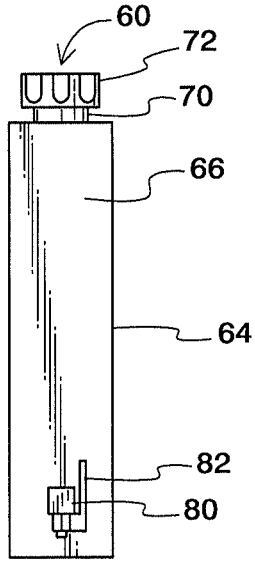
FIG. 6 is a front elevational view of one of the containers.

Referring now to FIGS. 6 and 7, dispensing station 10 includes a plurality of containers generally indicated at 60. In the preferred embodiment, as can be seen for example in FIGS. 2 and 3, three containers 60 are arranged in a side-by-side serial array extending parallel to the major surface of face panel 16. Containers 60 include a hollow container body 64 having a front wall 66 and an upper open end 70 enclosed by a threaded cap 72. In the preferred embodiment, containers 60 have a generally rectangular plinth-like configuration with walls joined generally at right angles. As can be seen in FIG. 3, this provides a convenient close nesting of containers when arranged in a side-by-side serial array. If space savings are not required, other configurations for containers 60 may be employed.

Referring now to FIGS. 1, 2, 6 and 7, containers 60 further include an integral lateral dispensing nozzle 80. As shown in FIGS. 1 and 2, dispensing nozzles 80 include operator levers 82 for operating internal valves (not shown) to allow the contents of containers 60 to be dispensed in a conventional manner. Although lever-type operators are shown in the illustrated embodiment, other types of nozzle operators, such as push button operators can be employed, as desired. Alternatively, containers 60 can be disposable cartridges with a pierceable portion in the bottom region thereof and the dispensing nozzles 80 can be permanently mounted in wall 66 as provided with an inwardly extending spike that pierces the container as the container is positioned for use.

As indicated in FIG. 3, it is generally preferred that the containers 60 are separate and independent from one another. For example, each container 60 is independently mounted within the dispensing station. Preferably, the containers 60 are independently mounted to face panel 16 and are carried by the face panel component of cabinet 12 for movement therewith. Each container 60 can be independently removed or replaced, as desired, without disturbing the remaining containers. FIG. 3 shows one container 60 being moved against face panel 16, before being filled and cap 72 being installed.

With continued reference to FIGS. 3, 6 and 7, the front walls 66 of containers 60 are arranged so as to fully seat against or otherwise contact the interior major surface of face panel 16, which is visible for example in FIG. 3. In FIGS. 6 and 7, body portion 92 has been omitted for drawing clarity.

FIGS. 1 and 2 show the fully assembled dispensing station in two stages of operation. In FIG. 1, the dispensing station is fully operational and ready for dispensing materials from the three containers 60, using their respective associated operator levers 82. In FIG. 2, the dispensing station is shown in a service configuration with the cabinet opened, face panel 16 having been pivoted away from housing 14. In a preferred embodiment, face panel 16 is released for pivoting to the opened or service position shown in FIG. 2 by releasing latch 40 to disengage the releasable securement with housing 14. The upper ends of container 60 then are readily accessible for servicing, by either independently removing, replacing or refilling the individual containers 60. For example, with reference to FIG. 3, caps 72 may be readily removed to expose openings 70 to gain access to the container interior, for refilling. Alternatively, the containers 60 may be lifted or withdrawn from the interior of housing 14 for free and ready access to service personnel.

If replacement of a particular container is desired, face panel 16 is swung to the open or service position illustrated in FIG. 2, and the container desired to be removed is lifted free of face panel 16 by passing the dispensing nozzle 80 through the apertures 88 formed in face panel 16 (see FIG. 4). In this manner, the container selected for removal can be readily lifted clear of face panel 16 as well as the remainder of dispensing station 10. At this point, the container may be replaced with a different container which is readily insertable in face panel 16.

Alternatively, the pivoting connection of face panel 16 may allow the face panel to be removed with respect to housing 14. By releasing optional flexible tether 50 (see FIG. 2), the face panel 16 with containers 60 attached can be removed as a single modular unit for service at a nearby or remote location. For example, if a large number of dispensing stations require more convenient servicing, a cart carrying pre-filled containers mounted to respective face panels can be made available for ready substitution of face panels of installed dispensing stations. In this manner, similarly sized face panels can be made to accommodate different numbers of containers and the dispensing stations may be readily modified by replacing the face panels and their associated containers. After servicing, the face panels are pivoted to the upright or closed position as illustrated in FIG. 1, and latch 40 is operated to re-engage housing 14, holding the face panel 16 in a fixed operational position.

It is generally preferred that housing 14 be dimensioned for a relatively close tolerance fit with respect to containers 60 that are held in the operational or service position shown in FIG. 1. In this manner, the containers 60 are securely held within cabinet 12 and conveniently withstand forces applied to nozzles 80 and their operating levers 82 which might otherwise dislodge or displace the containers positioning within cabinet 12. If desired, however, other arrangements may be provided, such as replacing housing 14 with the housing of enlarged interior dimensions. If additional securement is required for the containers 60, one or more straps (not shown) may be provided so as to hold the containers against face panel 16. Alternatively, vertically extending walls may be added to the shelf member 46 (see FIG. 5) so as to resist the rearwardly dislodgment of the containers with respect to the face panel.

As mentioned, the apertures 88 in face panel 16 (see FIG. 4) are generally circular and receive body portions 92 of dispensing nozzles 80 with a close tolerance fit (see FIG. 1). If desired, the face panel apertures 88 and the nozzle body portions 92 can be made to have polygonal or otherwise non-circular keyed interlocking configurations to further enhance the engagement and retention of the nozzle bodies with the face panel.

As indicated in the above, the containers 60 are generally provided with the same overall size and shape. The containers can be made of different sizes, if desired, so as to provide a greater quantity of one material with respect to another, within the same dispensing system. For example, with reference to FIG. 1, three containers are provided for dispensing station 10. In one instance, the dispensing station 10 is employed in a home laundry room or in a laundering facility, and bleach, fabric softener and detergent materials are provided respectively in each of the containers 60. If smaller quantities of bleach and fabric softener are required with respect to the amount of detergent, the central container 60 may be made wider and the outer containers 60 may be made narrower, allowing a relatively greater quantity of detergent in the central container than quantities of bleach and fabric softener in the outer containers. If only two materials are required, one container can be made twice as large, it being generally preferred that the larger container be provided with a plug-like locating body portion resembling the body portion 92 of the container that is no longer required at the dispensing station.

As mentioned, the containers 60 include a valve body portion 92 which extends through openings 88 with a relatively close tolerance fit. If desired, the valve body portion 92 may be omitted with nozzles 80 extending directly from the front face 66 of the container.

These and other advantages, variations and optional features are made possible with the present invention. It will be understood that the foregoing relates only to a preferred embodiment of the invention, and that numerous changes and modifications may be made therein without departing from the spirit and scope of the invention as defined in the following claims.

For commercial laundry application, the dispensing station can be provided with a coin-activated access to the dispensing nozzles. For example, the dispensing nozzles can be equipped with a solenoid-activated lock that makes the nozzles operable only after a predetermined amount of coinage has been deposited.

I claim:

1. A dispensing cabinet which comprises:

an upstanding housing having a base and defining an enclosure for receiving a plurality of containers, each provided with a lateral dispensing nozzle unitary therewith;

a face panel for the housing, having a bottom portion pivotably mounted to the housing adjacent to the base;

a shelf on the face panel, extending inwardly into the enclosure and sized to support the containers; and a flexible tether extending between the face panel and the housing so as to limit pivotal movement of the face panel with respect to the housing;

said face panel defining a number of apertures equal to the number of the dispensing containers and sized to receive therethrough the lateral dispensing nozzles.

2. The dispensing cabinet according to claim 1 wherein the face panel further includes side walls extending from the shelf so as to at least partly enclose the containers.

3. A dispensing cabinet which comprises:

an upstanding housing having a base and defining an enclosure for receiving a plurality of containers, each provided with a lateral dispensing nozzle unitary therewith;

a face panel for the housing, having a bottom portion pivotably mounted to the housing adjacent to the base;

a shelf on the face panel, extending inwardly into the enclosure and sized to support the containers;

said face panel defining a number of apertures equal to the number of the dispensing containers and sized to receive therethrough the lateral dispensing nozzles; and wherein the face panel further defines a plurality of viewing windows through which the containers are observable.

4. The dispensing cabinet according to claim 1 further including a releasable latch for releasably joining the face panel and the housing to hold the face panel in a predetermined position with respect to the housing.

5. A dispensing cabinet which comprises:

an upstanding housing having a base and defining an enclosure for receiving a plurality of containers, each provided with a lateral dispensing nozzle unitary therewith;

a face panel for the housing, having a bottom portion pivotably mounted to the housing adjacent to the base;

a shelf on the face panel, extending inwardly into the enclosure and sized to support the containers;

said face panel defining a number of apertures equal to the number of the dispensing containers and sized to receive therethrough the lateral dispensing nozzles; and wherein the housing further includes an outer surrounding frame for recessed mounting of the dispensing cabinet to a wall surface.

6. The dispensing cabinet according to claim 5 wherein the frame is attached to the housing so as to surround the face panel.

7. The dispensing cabinet according to claim 1 wherein the face panel is received within the housing for flush mounting with respect to housing portions surrounding the face panel.

8. The dispensing cabinet according to claim 1 wherein the housing further includes a pull out drawer adjacent the face panel in lower portion of the housing.

9. A liquid dispensing station which comprises:

a plurality of liquid containers;

a cabinet including an upstanding housing defining an opening communicating with a hollow interior, a base and a face panel selectably movable to close the opening;

the cabinet defining an enclosure dimensioned for receiving the plurality of liquid containers;

the face panel having a bottom portion pivotally mounted to the housing adjacent to the base for movement between a closed position closing the opening and an open position providing access to the hollow interior;

a shelf on the face panel, extending inwardly into the enclosure and sized to support the liquid containers;

said face panel defining a number of dispensing nozzles equal to the number of the liquid containers; and a plurality of viewing windows through which the liquid containers are viewable.

10. The liquid dispensing station according to claim 9 wherein the housing further defines a storage cavity disposed adjacent the face panel.

11. The liquid dispensing station according to claim 9 further including a releasable latch for releasably joining the face panel and the housing to hold the face panel in a predetermined position with respect to the housing.

12. The liquid dispensing station according to claim 9 wherein the face panel further includes side walls extending from the shelf so as to at least partly enclose the liquid containers.

13. The liquid dispensing station according to claim 9 further comprising a flexible tether extending between the face panel and the housing so as to limit pivotal movement of the face panel with respect to the housing.

* * * * *